United States Patent [19]

Albertine, Jr.

[11] 4,336,535

[45] Jun. 22, 1982

[54] CURSOR FOR PLASMA SHIFT REGISTER DISPLAY

[75] Inventor: Herman Albertine, Jr., Dallas, Tex.

[73] Assignee: NCR Corporation, Dayton, Ohio

[21] Appl. No.: 140,649

[22] Filed: Apr. 16, 1980

[51] Int. Cl.[3] ..... G09G 3/28

[52] U.S. Cl. ..... 340/768; 340/769; 340/773; 340/779; 313/188; 313/217; 315/169.2; 315/169.4

[58] Field of Search ..... 340/769, 767, 766, 753, 340/754, 774, 773, 779, 709; 315/169.4, 169.2; 313/188, 217

[56] References Cited

U.S. PATENT DOCUMENTS

| | | | |
|---|---|---|---|
| 3,336,499 | 8/1967 | O'Meara | 313/188 |
| 3,775,764 | 11/1973 | Gaur | 340/768 |
| 3,792,301 | 2/1974 | Kessler | 313/188 |
| 3,795,908 | 5/1974 | McDowell et al. | 340/768 |
| 3,872,352 | 3/1975 | Sasaki et al. | 340/774 |
| 3,911,422 | 10/1975 | McDowell et al. | 340/768 |
| 3,981,001 | 9/1976 | Ogle | 340/769 |
| 3,996,490 | 12/1976 | Miller | 313/217 |
| 4,127,794 | 11/1978 | Frankland | 315/169.4 |
| 4,190,789 | 2/1980 | Kawada et al. | 315/169.4 |
| 4,286,265 | 8/1981 | Kauffman et al. | 340/754 |

*Primary Examiner*—Marshall M. Curtis
*Attorney, Agent, or Firm*—J. T. Cavender

[57] ABSTRACT

This invention deals with an arrangement for incorporating a cursor feature into a plasma shift register display panel having a plurality of display channels. The cursor arrangement of the present invention is implemented by incorporating a separate cursor channel into such a display panel. The cursor channel is filled with an ionizable medium and has input, transfer and erase electrodes positioned on opposing walls thereof. The transfer electrodes are in turn arranged into four groups with two of the groups of electrodes being shared with the display channels of the panel. Through the synchronous application of suitable voltage potentials to the input, transfer and erase electrodes associated with the cursor channel, it is possible to input and transfer light dots through the cursor channel without having to regenerate the material being displayed by the panel and without fear of destroying the displayed material.

21 Claims, 8 Drawing Figures

CURSOR FOR PLASMA SHIFT REGISTER DISPLAY

BACKGROUND OF THE INVENTION

This invention relates in general to a display panel comprised of a plasma charge transfer device and, in particular, to an arrangement for incorporating a cursor feature into such a panel.

Display panels of the type to which the present invention pertains are well-known in the art. An example of such a display panel is given and described in U.S. Pat. No. 3,781,600, issued to Coleman et al. on Dec. 25, 1973, and entitled "Plasma Charge Transfer Device". This patent is incorporated by reference herein for all that it shows and teaches.

The display panel described in the referenced patent is comprised of an enclosure which is formed by a front and a rear plate with at least the front plate being constructed of a transparent material such as glass. The front and rear plates of the enclosure are maintained in a spaced-apart relationship and are sealed together along their outer perimeters to provide a hollow inner chamber which is divided into a plurality of parallel display channels. These display channels are in turn filled with an ionizable medium such as one of, or a mixture of, neon, argon, helium, kypton, xenon, hydrogen and nitrogen.

Input and erase electrodes are located at opposite ends of each display channel and a plurality of transfer electrodes are alternately disposed on the front and back plates of the panel to intersect each of the display channels. These transfer electrodes are in turn interconnected so that alternate electrodes on the front and rear plates are suitably connected to provide a four phase transfer electrode network. In this way, the transfer electrodes are arranged into four distinct groups with all of the electrodes of a group being interconnected.

By applying a suitable potential between adjacent electrodes on the opposing walls of a display channel, the gas between these two electrodes is ionized causing a light emission or light dot to occur. Through the synchronous application of a suitable voltage potential to the input, transfer and erase electrodes, such light dots can be introduced, shifted and held in place within the display channels of the panel. By combining several such display channels together into a single display panel, it is possible to provide a visual display of numbers, letters or other patterns; to shift the display of such numbers, letters or patterns along the length of the display panel; and to hold the display of such numbers, letters or patterns in place.

When using such a display panel, it is often necessary to highlight or otherwise designate a portion of the material being displayed. One technique for implementing such a feature is to incorporate into the display panel an arrangement for introducing and shifting a cursor line along the length thereof. In implementing such an arrangement, it is desirable to be able to operate the cursor independent of the remainder of the display panel so that a cursor line can be introduced to and shifted along the length of the panel without destroying the material being displayed or having to regenerate the displayed material each time the cursor line is moved.

SUMMARY OF THE INVENTION

It is therefore an object of the present invention to provide an arrangement for incorporating a cursor feature into a plasma shift register display panel to thereby provide a means for highlighting or designating a portion of the displayed material.

It is a further object of the present invention to provide an arrangement, of the character described, which is capable of inputting and shifting a cursor line comprised of a sequence of light dots along the length of a plasma shift register display panel without having to regenerate the displayed material each time a cursor line is inputted to or moved along the length of the panel.

The cursor arrangement of the present invention is implemented by adding a cursor channel to the top or bottom of the display panel. The cursor channel contains an ionizable medium and shares two groups of transfer electrodes with the display channels of the panel. The cursor channel, however, is also provided with additional transfer electrodes which control the introduction and shifting of light dots along the length thereof. These additional transfer electrodes are interconnected to form two new groups of electrodes which may be operated independently of the transfer electrodes located within the display channels of the panel. Independent input and erase electrodes are also included within the cursor channel. Through the synchronous application of a suitable voltage potential to the input, transfer and erase electrodes associated with the cursor channel, it is possible to incorporate into the display panel a cursor feature which is capable of being operated independently of the display channels of the panel.

DETAILED DESCRIPTION OF THE INVENTION

Figure 1:
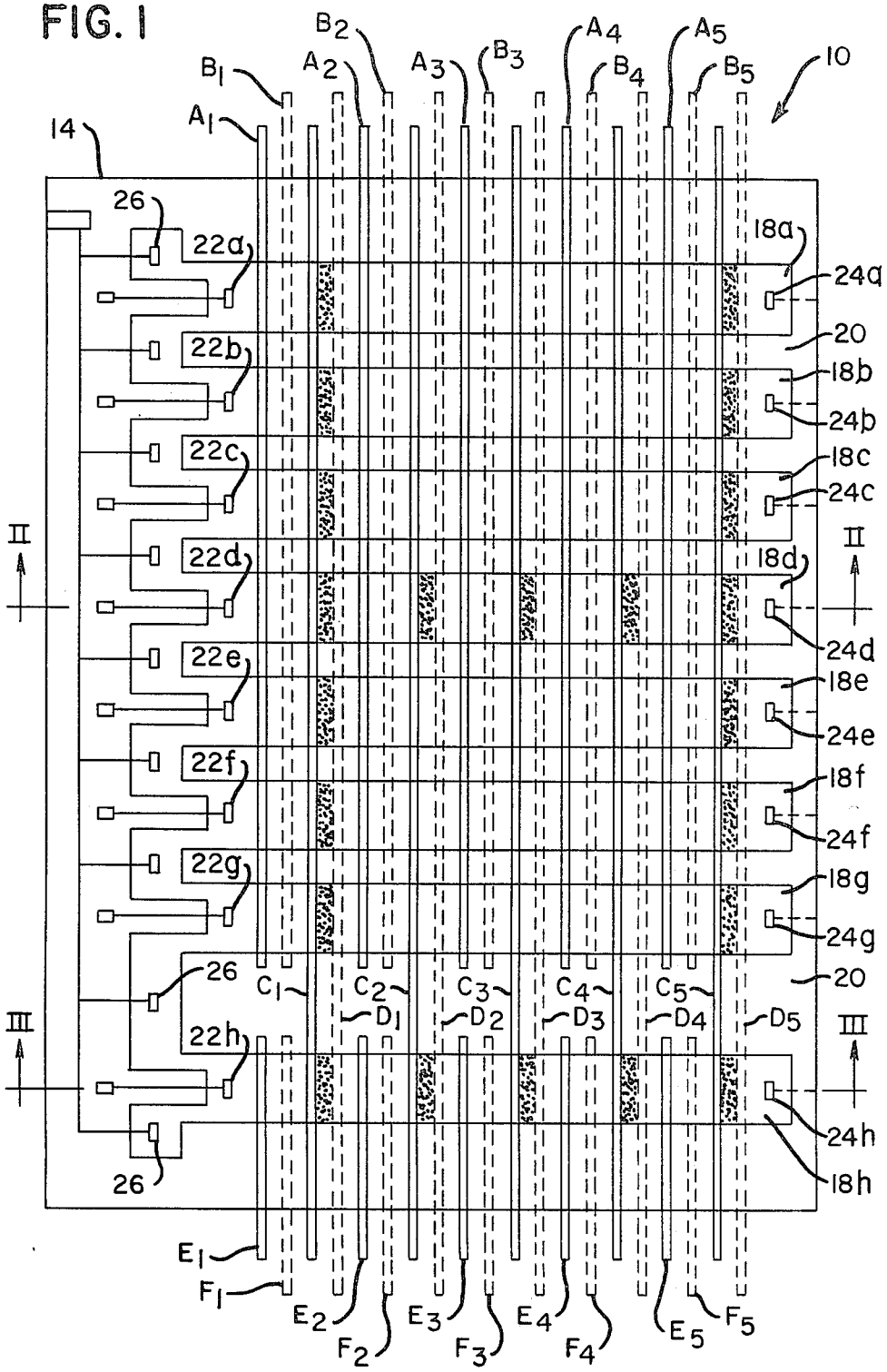
FIG. 1 is a top view, partially in schematic form, of a 5×7 plasma shift register display incorporating the cursor arrangement of the present invention.
Figure 2:
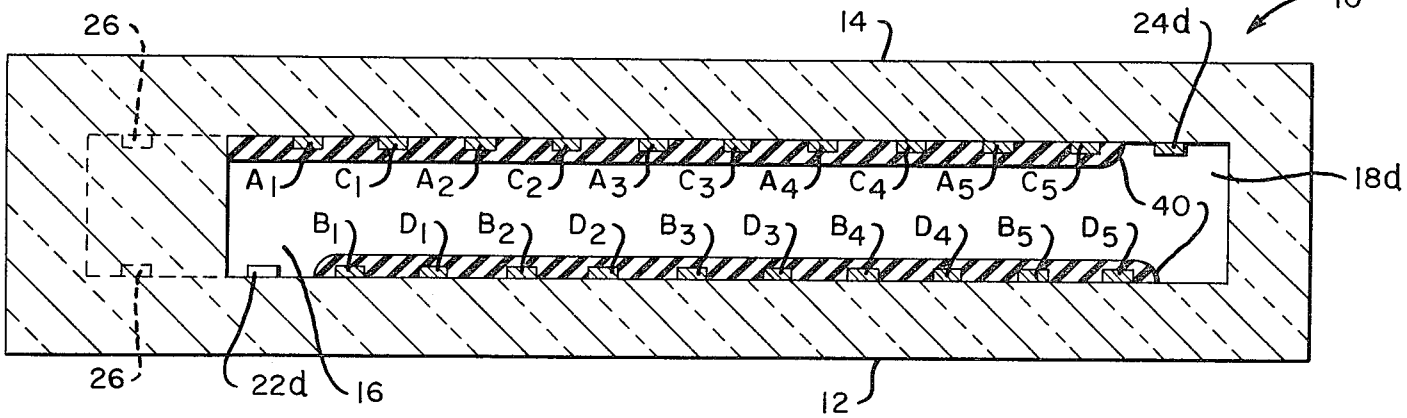
FIG. 2 is an enlarged cross-sectional view, partially in schematic form, taken along lines 2—2 in FIG. 1.
Figure 3:
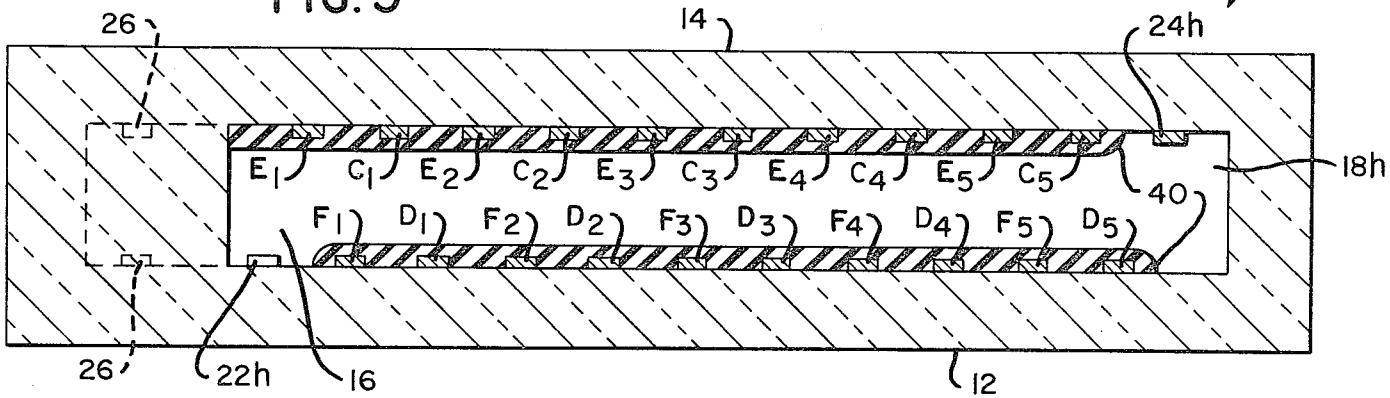
FIG. 3 is an enlarged cross-sectional view, partially in schematic form, taken along lines 3—3 in FIG. 1.

Reference is now made to FIGS. 1, 2 and 3 wherein a plasma shift register display panel which is constructed in accordance with a preferred embodiment of the present invention is generally designated by the numeral 10. As shown in these Figures, display panel 10 is comprised of a rear plate 12 and a front plate 14. In the usual practice of the invention, at least the front plate 14 is formed of a transparent material, for example, any suitable glass whereby ionization will result in a visible display. The plates 12 and 14 are held in spaced-apart relationship and are sealed along their outer perimeters to form a hollow inner chamber 16. Chamber 16 is in turn subdivided into a plurality of display channels 18*a–g* and a cursor channel 18*h*. Each of these parallel channels is separated from its adjacent channel by means of a channel-forming side wall 20 which is integrally formed with the front or back plate of the display panel. The display channels 18*a–g* and cursor channel 18*h* are filled with an ionizable gas such as any one of, or a mixture of, the gases neon, argon, helium, kypton, xenon, hydrogen and nitrogen.

Referring now to FIGS. 1, 2, 3, 4 and 5, each of the display channels 18*a–g* and the cursor channel 18*h* has an input electrode and an erase electrode positioned at opposite ends thereof. The input electrodes disposed in display channels 18*a–g* are respectively identified by the numerals 22*a–g*, while the input electrode disposed in cursor channel 18*h* is identified by the numeral 22*h*. The erase electrodes positioned in display channels 18*a–g* are respectively identified by the numerals 24*a–g*, while the erase electrode positioned in cursor channel 18*h* is identified by the numeral 24*h*. In addition, the display panel is equipped with a plurality of keep-alive electrodes 26. These electrodes are arranged in pairs and are positioned within the panel adjacent to a corresponding input electrode. The keep-alive electrodes 26 are capacitively coupled to the ionizable gas and are connected to an alternating voltage source of sufficient magnitude to ionize the gas located between each pair of keep-alive electrodes to provide a source of ionized particles.

Figure 4:
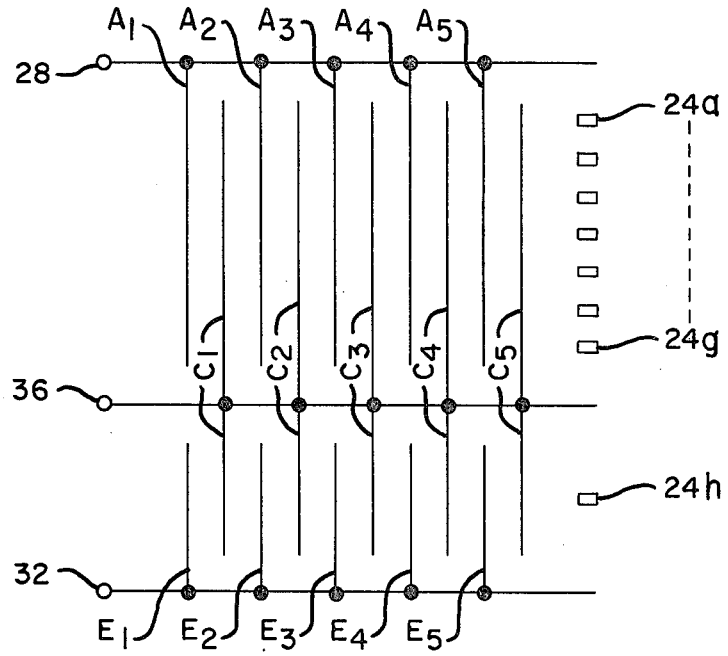
FIG. 4 is a schematic illustration of the arrangement of the transfer and erase electrodes on the front plate of a plasma shift register display panel constructed in accordance with the present invention.
Figure 5:
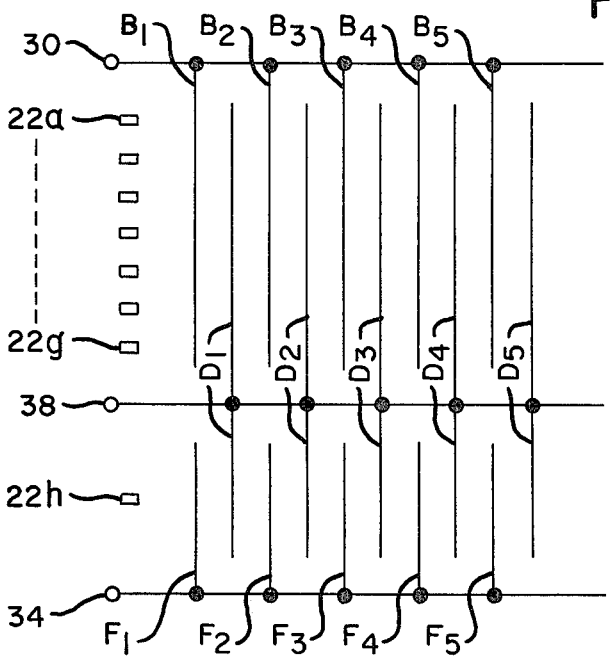
FIG. 5 is a schematic illustration of the arrangement of the transfer and input electrodes on the rear plate of a plasma shift register display panel constructed in accordance with the present invention.

A first plurality of transfer electrodes $A_1$–$A_5$ are disposed on the inner surface of the front plate 14 of the panel 10 such that each of these electrodes intersects each of the display channels 18*a–g*. The transfer electrodes $A_1$–$A_5$ are commonly connected to a single input terminal 28 (FIG. 4) and are collectively referred to as the A transfer electrodes. A second plurality of transfer electrodes $B_1$–$B_5$ are disposed on the inner surface of rear plate 12 such that each of these electrodes intersects each of the display channels 18*a–g*. The transfer electrodes $B_1$–$B_5$ are similarly connected to a common input terminal 30 (FIG. 5) and are collectively referred to as the B transfer electrodes. Another plurality of transfer electrodes $E_1$–$E_5$ are disposed on front plate 14 and are arranged to only intersect cursor channel 18*h*. These transfer electrodes are collectively referred to as the E transfer electrodes and are electrically coupled to a common input terminal 32 (FIG. 4). A further plurality of transfer electrodes $F_1$–$F_5$ are disposed on the inner surface of rear plate 12. These electrodes are arranged to intersect only the cursor channel 18*h* and are commonly connected to a single input terminal 34 (FIG. 5). The transfer electrodes $F_1$–$F_5$ are collectively referred to as the F transfer electrodes. An additional plurality of transfer electrodes $C_1$–$C_5$ are disposed on the inner surface of front plate 14 and are arranged to intersect each of the display channels 18*a–g* and the cursor channel 18*h*. The transfer electrodes $C_1$–$C_5$ are collectively referred to as the C transfer electrodes and are commonly connected to a single input terminal 36 (FIG. 4). A final plurality of transfer electrodes $D_1$–$D_5$ are disposed on the inner surface of rear plate 12 such that each of these electrodes intersects each of the display channels 18*a–g* and the cursor channel 18*h*. These electrodes are collectively referred to as the D transfer electrodes and are commonly connected to a single input terminal 38 (FIG. 5).

Referring now primarily to FIGS. 1 and 2, the transfer electrodes are arranged in the display channels 18*a–g* in a regularly repeating sequence which is comprised of one of the A transfer electrodes, one of the B transfer electrodes, one of the C transfer electrodes and one of the D transfer electrodes. The transfer electrodes of each such sequence are in turn alternately disposed on the front and rear plates of the panel in an offset configuration. In particular, the first such sequence of transfer electrodes is originated by the transfer electrode $A_1$ which is positioned on the front plate 14 of the panel 10. The next transfer electrode of the first sequence is transfer electrode $B_1$ which is disposed on the rear plate 12 of panel 10 adjacent to transfer electrode $A_1$ and laterally offset therefrom. The third electrode of the first sequence is transfer electrode $C_1$. Transfer electrode $C_1$ is disposed on the front plate 14 of the display panel 10 such that it is laterally offset from its adjacent electrode $B_1$. Transfer electrode $D_1$ forms the last electrode of the first sequence of electrodes within the display channels 18*a–g*. This electrode is disposed on the rear plate 12 in a laterally offset position from its adjacent electrode $C_1$. The second sequence of transfer electrodes within the display channels 18*a–g* is comprised of the transfer electrodes designated by the letters $A_2$, $B_2$, $C_2$ and $D_2$ while the third sequence is comprised of the electrodes designated by the letters $A_3$, $B_3$, $C_3$ and $D_3$ and so on.

As shown best in FIGS. 1 and 3, the transfer electrodes are arranged in the cursor channel 18*h* in a regularly repeating sequence comprised of one of the E transfer electrodes, one of the F transfer electrodes, one of the C transfer electrodes and one of the D transfer electrodes and are disposed on the front and rear plates of the panel in a staggered configuration. In particular, the transfer electrode $E_1$ forms the first electrode of the first of the regularly repeating sequences of transfer electrodes within the cursor channel 18*h*. The electrode $E_1$ is positioned on front plate 14 and is generally aligned with the transfer electrode $A_1$. Even through transfer electrodes $A_1$ and $E_1$ are aligned, they are electrically isolated from each other and, as a result, conduct independently of each other. The next transfer electrode of the first sequence is transfer electrode $F_1$ which is disposed on the inner surface of the rear plate 12 adjacent to electrode $E_1$. In this position, transfer electrode $F_1$ is generally aligned with transfer electrode $B_1$. As with transfer electrodes $A_1$ and $E_1$, transfer electrodes $F_1$ and $B_1$ are electrically isolated from each other. Transfer electrode $C_1$ forms the next electrode of the first sequence of transfer electrodes within the cursor channel 18*h*. Transfer electrode $C_1$ is disposed on the front plate 14 of the panel such that it is adjacent to and laterally offset from transfer electrode $F_1$. The final transfer electrode of the first sequence is transfer electrode $D_1$ which is positioned on the rear plate 12 adjacent to transfer electrode $C_1$ and laterally offset therefrom. Similarly, the second sequence of transfer electrodes within the cursor channel 18*h* is comprised of the transfer electrodes designated by the letters $E_2$, $F_2$, $C_2$ and $D_2$ while the third sequence is comprised of the transfer electrodes designated by the letters $E_3$, $F_3$, $C_3$ and $D_3$ and so on.

The electrodes which are disposed on the front plate 14 of the display panel 10 are typically formed of a transparent material such as tin oxide. In addition, a thin insulator coating 40 (shown in FIGS. 2 and 3) covers all of the transfer and keep alive electrodes. This coating is typically transparent and is comprised of a dielectric glass formed of a silk screened glass plate.

Since all of the A transfer electrodes are commonly connected to input terminal 28, the application of a voltage pulse to this input terminal causes the potential of each of the A transfer electrodes ($A_1$, $A_2$, $A_3$, $A_4$ and $A_5$) to be changed in unison. Similarly, the application of a voltage pulse to input terminal 30 causes all of the B transfer electrodes ($B_1$, $B_2$, $B_3$, $B_4$ and $B_5$) to exhibit a corresponding voltage change and so on. By applying a suitable potential between adjacent electrodes on the front and rear plates of the display panel, the ionizable gas between these two electrodes is ionized causing a discharge to occur. This discharge in turn causes a corresponding wall charge to be trapped on the insulator coating 40 adjacent to the electrodes and a perceptible light emission to occur. Such a light emission is referred to herein as a light dot. Through the synchronous application of a suitable voltage potential to the input, transfer and erase electrodes such light dots can be introduced, shifted and held in place within the channels.

FIGS. 1, 2, 3, 4 and 5 illustrate a display panel 10 comprising seven display channels 18*a–g* which cooperate to display alpha-numeric characters and a cursor channel, 18*h*, for incorporating a cursor function into the panel. Channels 18*a–g* form a 5×7 matrix array which is shown herein displaying a single character, the letter "H". For purposes of illustration only, the display is shown herein as a single character display. The display device can be made to display additional characters by simply increasing the length of the device and adding additional sequences of transfer electrodes.

In operation, all of the transfer electrodes are normally maintained at a set voltage potential. A character is inputted to the display panel 10 by dividing the character into a plurality of columns and then successively inputting to the panel a pattern of light dots corresponding to each column of the character. Each such pattern of light dots is inputted to the display panel 10 by placing the desired combination of input electrodes 22*a–g* at a predetermined voltage and then pulsing the A transfer electrodes to zero potential. This action produces between the selected combination of input electrodes and transfer electrode $A_1$ a potential difference of sufficient magnitude to ionize the gas located between these two electrodes. Ionization of the gas in this manner produces a visually perceptible light dot and causes a wall charge to accumulate adjacent to transfer electrode $A_1$. In this way, a light dot is produced in each of the display channels 18*a–g* containing a selected input electrode and a wall charge is stored on the insulator coating of each of these display channels adjacent transfer electrode $A_1$ to form an accumulated pattern of wall charge corresponding to the selected combination of input electrodes. The voltage attributed to the wall charge has a polarity opposite to the applied voltage which initiated the discharge and, as a result, reduces the potential difference between these electrodes below that needed to produce an ionization of the gas located between them.

The B, C and D transfer electrodes are then pulsed to ground in sequence to shift the accumulated pattern of wall charge through the display panel 10. In particular, pulsing the B transfer electrodes to ground produces between transfer electrode $A_1$ and transfer electrode $B_1$ in those display channels in which a wall charge has been accumulated a voltage difference sufficient to cause ionization of the gas located between these two electrodes. This ionization of the gas produces a visibly perceptible light dot and causes the accumulated pattern of wall charge to be transferred to transfer electrode $B_1$. The gas contained within the remaining display channels, however, is not ionized because the voltage difference between the $A_1$ and $B_1$ transfer electrodes in these display channels is not sufficient to ionize the gas located between these two electrodes. Thereafter, the wall charge is similarly transferred between transfer electrodes $B_1$ and $C_1$. A transfer between transfer electrodes $C_1$ and $D_1$ is then likewise produced.

Once the accumulated pattern of wall charge has been transferred to transfer electrode $D_1$, a second combination of light dots can be introduced to the panel 10 by applying the predetermined voltage to the appropriate combination of input electrodes and once again pulsing the A transfer electrodes to ground. Pulsing the A transfer electrodes to ground causes a new wall charge pattern to be introduced to the panel and the previously-inputted wall charge pattern to be transferred between transfer electrode $D_1$ and transfer electrode $A_2$. In this way, a series of wall charge patterns may be introduced into the display channels 18*a–g* and shifted along the entire length thereof.

Once a desired pattern of light dots has been entered into the display panel, the dots may be held and displayed by alternately pulsing the C and D transfer electrodes to ground. In this way, the wall charge pattern associated with the light dots is continuously transferred between the C and D transfer electrodes of the display panel with a visually discernible light dot being produced during each such charge transfer. To the observer, these light dots are substantially stationary, thereby producing a stationary display of the inputted pattern.

The cursor channel 18*h* is operated in the same manner with the exception that the E and F transfer electrodes rather than the A and B transfer electrodes are used to control the inputting of light dots into the cursor channel and the shifting of such dots along the length thereof.

Figure 6A:
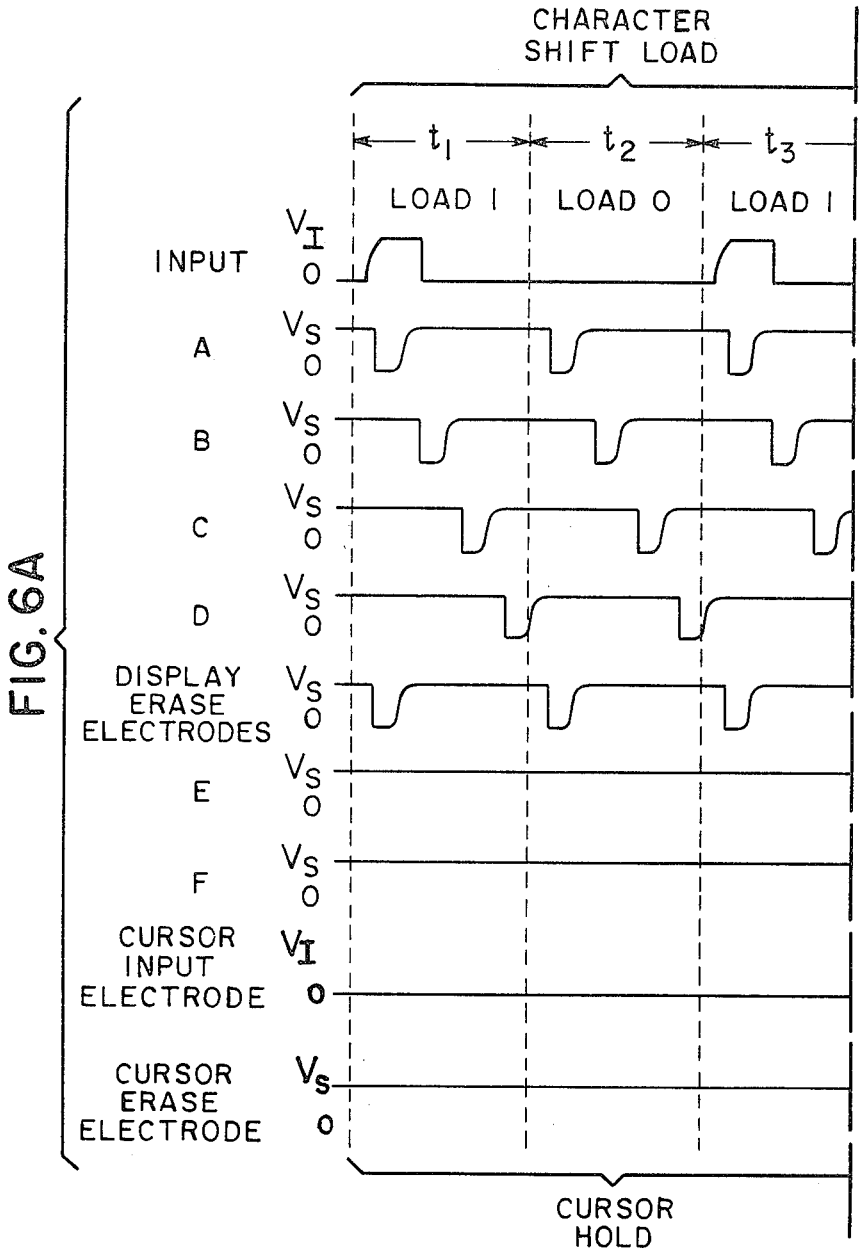
FIGS. 6A and 6B illustrate waveforms which are characteristic of the operation of the present invention.
Figure 6B:
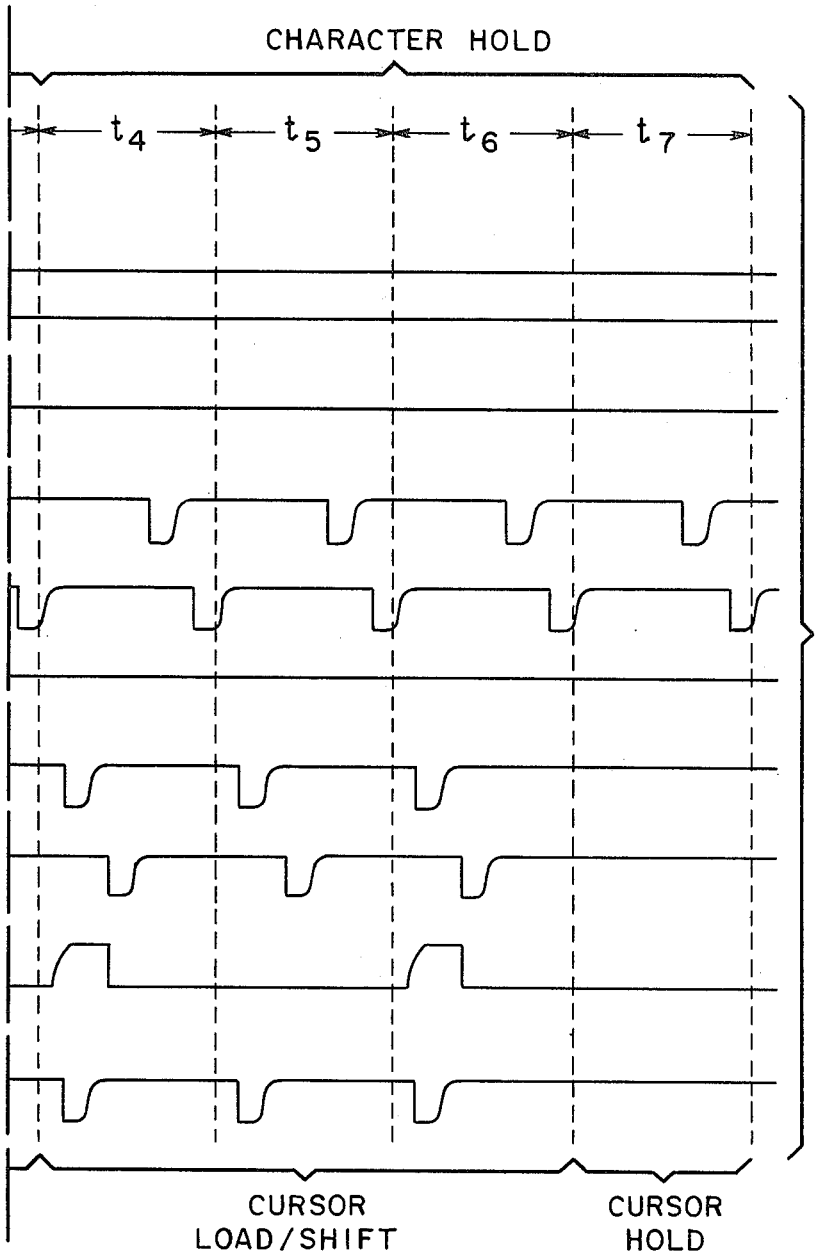

Referring now to FIGS. 6A and B, a timing diagram illustrating the voltage pulses which may be applied to the input, transfer and erase electrodes to effectuate operation of the display panel 10 is shown in these Figures. The timing diagram of FIGS. 6A and B illustrates the load, shift and hold operations performed in the display channels 18*a–g* and the cursor channel 18*h*. In the timing diagram, the sequence of voltage pulses needed to load and shift light dots through the display channels 18*a–g* is shown in time periods $t_1$–$t_3$ while the sequence of voltage pulses needed to hold an inputted pattern of light dots within the display channels is shown in time periods $t_4$–$t_7$. Time periods $t_4$–$t_6$ illustrate the sequence of voltage pulses required to load and shift a light dot through the cursor channel 18*h* while time periods $t_1$–$t_3$ and $t_7$ show the sequence of voltage pulses required to hold an inputted light dot at a stationary position within the cursor channel.

As shown in FIGS. 6A and B, the transfer electrodes are normally maintained at a set voltage potential $V_S$ and are pulsed to ground in a set relationship in order to effectuate the operation of the display panel 10. The voltage potential $V_s$ is sufficient to produce a discharge when added to a wall charge of like polarity but is less than the voltage needed to produce a discharge in the absence of a like wall charge.

A character is loaded into the display device by successively inputting into the various display channels 18*a–g* the sequence of light dots needed to form the desired character. A light dot is in turn loaded into a designated display channel by generating the combination of voltage pulses shown in time period $t_1$ of FIGS. 6A and B. In particular, a predetermined voltage $V_I$ is initially applied to the input electrode located within the designated display channel. Applying the voltage $V_I$ to this input electrode does not immediately produce within the designated display channel an ionization of the gas located between the input electrode and transfer electrode $A_1$ because the voltage potential between these two electrodes is not sufficient to initiate ionization of the gas because $A_1$ initially is at $V_S$. The A transfer electrodes are then pulsed to zero potential producing between the input electrode of the designated display channel and transfer electrode $A_1$ a voltage difference of sufficient magnitude to ionize the gas located between these two electrodes. Ionization of the gas located between these two electrodes causes a perceptible light dot to be produced and a positive wall charge to be trapped on the insulator coating 40 of the designated display channel adjacent to transfer electrode $A_1$. A corresponding charge does not accumulate at the input electrode of the designated display channel because the input electrode is directly coupled to the ionizable gas contained within the channel. Additionally, no charge is deposited on any of the other transfer electrodes within the designated display channel since there has been no gaseous discharge between any of the other electrodes, even though all of the A transfer electrodes were simultaneously pulsed to ground.

The B transfer electrodes are then pulsed to ground while the A, C, D, E and F transfer electrodes are held at the voltage $V_S$. In the designated channel, the wall charge present on the insulator coating 40 adjacent to transfer electrode $A_1$ combines with the voltage applied to this electrode to produce between transfer electrode $A_1$ and transfer electrode $B_1$ a voltage difference sufficient to ionize the gas located within the designated channel between these two electrodes. Ionization of the gas in this manner produces a visually perceptible light dot and causes the wall charge previously stored adjacent to transfer electrode $A_1$ to be stored on the insulator coating 40 of the designated display channel adjacent to transfer electrode $B_1$. This discharge also causes a reversal in the polarity of the charge stored on the insulator coating 40 (FIG. 2) of the designated display channel adjacent to transfer electrode $A_1$.

As indicated in FIG. 6A, the C and D transfer electrodes are then pulsed to ground in sequence. This action shifts the inputted wall charge to the insulator coating 40 of the designated display channel adjacent to transfer electrode $D_1$.

The inputted light dot can then be shifted through the designated channel without causing another light dot to be entered into the channel by generating the sequence of voltage signals shown in the time period $t_2$. As shown therein, the A, B, C and D transfer electrodes are sequentially pulsed to ground without a positive voltage pulse being present at the input electrode associated with the designated display channel. In particular, switching the A transfer electrodes to ground causes the charge stored on the insulator coating 40 of the designated display channel adjacent to transfer electrode $D_1$ to be transferred to the insulator coating 40 of the designated display channel adjacent to transfer electrode $A_2$. The B, C and D transfer electrodes are then pulsed to ground in succession causing the inputted wall charge to be transferred through the designated channel and to be stored on the insulator coating 40 of the designated channel adjacent to the transfer electrode $D_2$. A new charge, however, was not inputted to the designated display channel since the channel's input electrode remained at ground potential during the pulsing sequence. If, however, the predetermined voltage $V_I$ had been applied to the designated channel's associated input electrode coincident with the pulsing of the A transfer electrodes to ground, as shown in time period $t_3$, the previously entered charge would have been shifted to the next sequence of electrodes and a new charge would have been applied to the display device as described above.

A light dot may be inputted to the cursor channel 18*h* by generating the sequence of signals shown in time period $t_4$. In particular, the input electrode 22*h* (FIGS. 1 and 4) associated with the cursor channel is pulsed to the positive voltage $V_I$. The E transfer electrodes are then pulsed to ground causing the gas located within the cursor channel 18*h* between input electrode 22*h* and transfer electrode $E_1$ to be ionized, thereby producing a light dot and imposing a positive charge on the insulator coating 40 of the cursor channel adjacent to transfer electrode $E_1$. Thereafter, the F transfer electrodes are pulsed to ground, resulting in a transfer of the charge stored on the insulator coating 40 adjacent to transfer electrode $E_1$ to the insulator coating 40 on the opposite wall of the cursor channel adjacent to transfer electrode $F_1$. As shown in FIGS. 6A and B, the C and D transfer electrodes are then sequentially pulsed to ground causing the wall charge to be further shifted through the cursor channel 18*h* and to be imposed on the insulator coating 40 of the cursor channel adjacent to transfer electrode $D_1$. The display device is then in condition to either shift the inputted light dot along the cursor channel 18*h* without the introduction of a second light dot, as shown in time period $t_5$, or shift the light dot along the cursor channel 18*h* coincident with the introduction of a second light dot, as shown in time period $t_6$. To shift a light dot through the cursor channel without the introduction of another light dot, the E, F, C and D transfer electrodes are sequentially pulsed to ground while the input electrode 22*h* associated with the cursor channel 18*h* is maintained at ground potential. A previously inputted light dot is shifted through the cursor channel 18*h* along with the introduction of a new light dot into the channel by first applying the predetermined voltage $V_I$ to input electrode 22*h* and then sequentially pulsing the E, F, C and D transfer electrodes to ground as shown in time period $t_6$.

An inputted pattern of light dots may be held in a stationary position within the display channels 18*a–g* by alternately pulsing the C and D transfer electrodes to ground as shown in time periods $t_4$–$t_7$. Similarly, an inputted pattern of light dots may be held in place within the cursor channel 22*h* by alternately pulsing the C and D transfer electrodes to ground as shown in time periods $t_1$–$t_3$ and $t_7$. This alternate pulsing of the C and D transfer electrodes causes the stored wall charge to be alternately transferred between adjacent C and D transfer electrodes. Each of these transfers in turn produces a perceptible light dot which appears to be substantially stationary to an observer.

Since the A and B transfer electrodes are used to control the inputting and shifting of light dots through the display channels 18*a–g* while the E and F transfer electrodes are used to control the inputting and shifting of light dots through the cursor channel 18*h*, these electrodes can be operated coincidentally to input light dots to the display and cursor channels in unison or independently to input light dots to the display and cursor channels separately. By maintaining the timing relationship shown in FIGS. 6A and B, it is also possible to input and shift light dots through the cursor channel while light dots are being held in a stationary position within the display channels and vice versa. Accordingly, the cursor and display channels can be operated independently of each other such that light dots can be inputted to and shifted along the length of the cursor channel without destroying or having to regenerate the displayed materials each time the light dots are moved.

Figure 7:
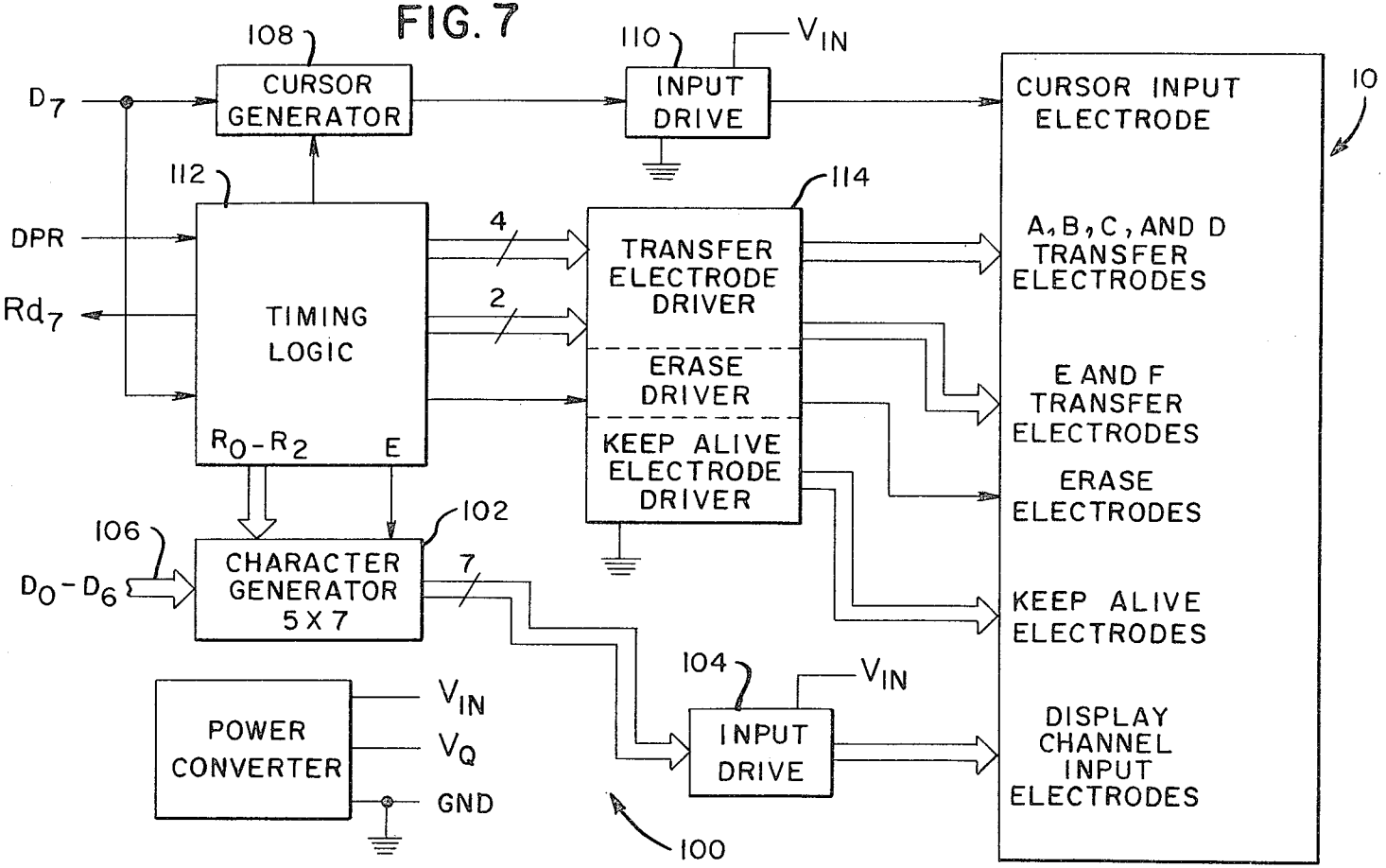
FIG. 7 is a block diagram of a control circuit for use with the display panel of the present invention.

Reference is now made to FIG. 7 wherein a control circuit suitable for driving a display panel constructed in accordance with a preferred embodiment of the present invention is shown in block form and is generally designated by the numeral 100. The voltage signals which are used to control the inputting of light dots to the display channels 18*a–g* are applied to the input electrodes 22*a–g* by means of an input driver 104 in response to control signals from a character generator 102. Character generator 102 is arranged to receive a signal which is representative of a particular character from an external source via an input bus 106. The input signal received by the character generator 102 is then converted into five sets of control signals with each set of control signals corresponding to one column of the character to be displayed. The five sets of control signals are then sequentially provided to input driver 104. The input driver 104 responds to each set of control signals by applying the predetermined voltage $V_I$ to the combination of input electrodes designated by the received set of control signals.

Control circuit 100 also includes a cursor generator 108 and an associated driver circuit 110 for controlling the application of voltage signals to input electrode 22*h* to control the introduction of light dots into this channel. As shown in FIG. 7, cursor generator 108 and its associated input driver 110 are arranged to operate independent of character generator 102 and its associated input driver 104. In this way, characters and a cursor line can be introduced into the display panel 10 independently of each other.

Control circuit 100 also includes a timing logic circuit 112 which is operable to generate all of the timing signals needed to perform the load, shift and hold operations shown in FIGS. 6A and B and to synchronize the operation of cursor generator 108 and character generator 102 with the various timing signals generated by the timing logic circuit. The timing logic circuit 112 is a conventional circuit which is operable to selectively generate timing signals corresponding to the A and B transfer electrodes to control the introduction and shifting of light dots through the display channels 18*a–g*, to selectively generate timing signals corresponding to the E and F transfer electrodes to control the introduction and shifting of light dots through the cursor channel 18*h* and to periodically generate timing signals corresponding to the C and D transfer electrodes to cooperate in the transfer of light dots through the display and/or cursor channels of the panel or to hold light dots in a stationary position within the display and/or cursor channels of the panel. To effectuate this type of operation, timing logic circuit 112 is capable of generating the timing signals corresponding to the A and B transfer electrodes and the timing signals corresponding to E and F transfer electrodes either separately or in unison. In this way, light dots can be loaded into and shifted through the cursor channel either in unison with or separate from the introduction and shifting of light dots through the display channels. The timing signals produced by the timing logic circuit 112 are in turn provided to an associated input driver 114 where they are used to control the pulsing of the various transfer electrodes to zero voltage potential to effectuate the operation of the display panel 10. Timing logic circuit 112 and input driver 114 are also operable to control the application of voltage signals to the erase electrodes 22*a–h* of the panel and to control the application of voltage signals to the keep alive electrodes 26 of the panel.

From the foregoing, it can be seen that this invention is one well adapted to attain all of the ends and objects hereinabove set forth together with other advantages which are obvious and which are inherent to the structure.

While the invention has been particularly shown and described with reference to preferred embodiments thereof, it will be understood by those skilled in the art that various changes in form and detail may be made therein without departing from the spirit and scope of the invention.

I claim:

1. A plasma shift register display panel comprising:

at least one display channel defined by a front wall surface and an opposite rear wall surface and containing an ionizable medium;

a cursor channel defined by a front wall surface and an opposite rear wall surface, said cursor channel being positioned adjacent to said display channel and containing an ionizable medium;

a first plurality of transfer electrodes periodically positioned within said display channel;

a second plurality of transfer electrodes periodically positioned within said cursor channel; and at third plurality of transfer electrodes periodically positioned within said display channel and within said cursor channel.

2. A plasma shift register display panel as set forth in claim 1 including drive means for selectively applying potential to the transfer electrodes of said first plurality of transfer electrodes, said drive means being further operable to selectively apply potential to the transfer electrodes of said second plurality of transfer electrodes and to periodically apply potential to the transfer electrodes of said third plurality of transfer electrodes.

3. A plasma shift register display panel as set forth in claim 1 wherein the transfer electrodes of said first plurality of transfer electrodes are arranged in pairs with the transfer electrodes of each such pair being periodically disposed on the opposing front and rear wall surfaces of said display channel in an offset relationship.

4. A plasma shift register display panel as set forth in claim 3 wherein the transfer electrodes of said second plurality of transfer electrodes are arranged in pairs with the transfer electrodes of each such pair being periodically disposed on the opposing front and rear wall surfaces of said cursor channel in an offset relationship.

5. A plasma shift register display panel as set forth in claim 4 wherein the transfer electrodes of said third plurality of transfer electrodes are arranged in pairs with each such pair being periodically disposed on the opposing front and rear wall surfaces of said display channel and said cursor channel in a laterally offset relationship.

6. A plasma shift register display panel comprising:

at least one display channel defined by a front wall surface and an opposite, rear wall surface and containing an ionizable medium;

a cursor channel defined by a front wall surface and an opposing rear wall surface, said cursor channel being positioned adjacent to said display channel and containing an ionizable medium;

a first input electrode located within said display channel;

a second input electrode located within said cursor channel;

a pair of first transfer electrodes positioned on the opposing front and rear wall surfaces of said display channel adjacent to said first input electrode;

a pair of second transfer electrodes positioned on the opposing front and rear wall surfaces of said cursor channel adjacent to said second input electrode; and a pair of third transfer electrodes positioned on the opposing front and rear wall surfaces of said display and cursor channels adjacent to said pair of first transfer electrodes and said second pair of transfer electrodes, respectively.

7. A plasma shift register display panel as set forth in claim 5 including drive means for selectively pulsing each transfer electrode of said first pair of transfer electrodes to a predetermined voltage in succession, said drive means being further operable to selectively pulse each transfer electrode of said second pair of transfer electrodes to a predetermined voltage in succession and to periodically pulse each transfer electrode of said third pair of transfer electrodes to a predetermined voltage in succession.

8. A plasma shift register display panel comprising:

at least one display channel defined by a front wall surface and an opposing rear wall surface and containing an ionizable medium;

a cursor channel defined by a front wall surface, and an opposite rear wall surface, said cursor channel being positioned adjacent to said display channel and containing an ionizable medium;

a first plurality of transfer electrodes electrically coupled together, said first plurality of transfer electrodes being arranged to intersect said display channel;

a second plurality of transfer electrodes electrically coupled together, said second plurality of transfer electrodes being arranged to intersect said display channel;

a third plurality of transfer electrodes electrically coupled together, said third plurality of transfer electrodes being arranged to intersect said cursor channel;

a fourth plurality of transfer electrodes electrically coupled together, said fourth plurality of transfer electrodes being arranged to intersect said cursor channel;

a fifth plurality of transfer electrodes electrically coupled together, said fifth plurality of transfer electrodes being arranged to intersect said display channel and said cursor channel;

a sixth plurality of transfer electrodes electrically coupled together, said sixth plurality of electrodes arranged to intersect said display channel and said cursor channel;

said first, second, fifth and sixth pluralities of transfer electrodes being arranged in a regularly occurring sequence formed by one of the transfer electrodes of said first plurality of transfer electrodes, one of the transfer electrodes of said second plurality of transfer electrodes, one of the transfer electrodes of said fifth plurality of transfer electrodes, and one of the transfer electrodes of said sixth plurality of transfer electrodes wherein the transfer electrodes of each sequence are positioned on opposite inside wall surfaces of said display channel in an alternating sequence and offset from one another; and said third, fourth, fifth and sixth pluralities of transfer electrodes being arranged in a regularly occurring sequence formed by one of the transfer electrodes of said third plurality of transfer electrodes, one of the transfer electrodes of said fourth plurality of transfer electrodes, one of the transfer electrodes of said fifth plurality of transfer electrodes and one of the transfer electrodes of said sixth plurality of transfer electrodes wherein the transfer electrodes of each sequence are positioned on opposite inside wall surfaces of said cursor channel in an alternating sequence and offset from one another.

9. A plasma shift register display panel as set forth in claim 8 including drive means for selectively pulsing said first and second pluralities of transfer electrodes to a preselected voltage in succession, said drive means being further operable to selectively pulse said third and fourth pluralities of transfer electrodes to a preselected voltage in succession and to periodically pulse said fifth and sixth pluralities of transfer electrodes to a preselected voltage in succession.

10. A plasma shift register display panel for providing a visual display of light dots, said panel comprising:

at least one display channel defined by a front wall surface and an opposite rear wall surface and containing an ionizable medium;

a cursor channel defined by a front wall surface and an opposite rear wall surface, said cursor channel being positioned adjacent to said display channel and containing an ionizable medium;

a first plurality of electrode means for controlling the introduction and shifting of light dots through said display channel;

a second plurality of electrode means for controlling the introduction and shifting of light dots through said cursor channel; and a third plurality of electrode means for cooperating with said first plurality of electrode means in the introduction and shifting of light dots through said display channel and with said second plurality of electrode means in the introduction and shifting of light dots through said cursor channel and for providing a stationary display of light dots at a set position within said display channel and at a set position within said cursor channel.

11. A plasma shift register display panel as set forth in claim 10 wherein said first plurality of electrode means is comprised of a first plurality of transfer electrodes periodically positioned within said display channel.

12. A plasma shift register display panel as set forth in claim 11 wherein the transfer electrodes of said first plurality of transfer electrodes are arranged in pairs with the transfer electrodes of each such pair being periodically disposed on the opposing front and rear wall surfaces of said display channel in an offset relationship.

13. A plasma shift register display panel as set forth in claim 11 wherein said second plurality of electrode means is comprised of a second plurality of transfer electrodes periodically positioned within said cursor channel.

14. A plasma shift register display panel as set forth in claim 13 wherein the transfer electrodes of said second plurality of transfer electrodes are arranged in pairs with the transfer electrodes of each such pair being periodically disposed on the opposing front and rear wall surfaces of said cursor channel in an offset relationship.

15. A plasma shift register display panel as set forth in claim 13 wherein said third plurality of electrode means is comprised of a third plurality of transfer electrodes periodically positioned within said display channel and said cursor channel.

16. A plasma shift register display as set forth in claim 15 wherein the transfer electrodes of said third plurality of electrodes are arranged in pairs with each such pair being periodically disposed on the opposing front and rear wall surfaces of said display channel and said cursor channel in a laterally offset relationship.

17. A plasma shift register display panel as set forth in claims 1, 6 or 12 including a first input electrode located at one end of said display channel and a second input electrode located at one end of said cursor channel.

18. A plasma shift register display panel as set forth in claim 17 including means for selectively applying a predetermined voltage potential to said first input electrode and means for selectively applying a predetermined voltage potential to said second input electrode.

19. A plasma shift register display panel as set forth in claim 17 including a first erase electrode positioned at the other end of said display channel and a second erase electrode positioned at the other end of said cursor channel.

20. A plasma shift register display panel as set forth in claim 19 wherein a transparent insulating layer is applied over said transfer electrodes, said input electrode being exposed to said ionizable medium.

21. A plasma shift register display panel as set forth in claim 20 wherein said transfer, input and erase electrodes are formed of transparent material.

* * * * *